US005626130A

United States Patent [19]

Vincent et al.

[11] Patent Number: 5,626,130

[45] Date of Patent: May 6, 1997

[54] RESPIRATORY NOSE-ONLY DEVICE AND SYSTEM FOR LABORATORY ANIMALS

[75] Inventors: Renaud Vincent, Aylmer; Josée Guénette, Hull, both of Canada

[73] Assignee: Her Majesty the Queen in right of Canada, as represented by the Minister of Health, Ottawa, Canada

[21] Appl. No.: 563,945

[22] Filed: Nov. 22, 1995

[51] Int. Cl.[6] ..... A61D 7/04

[52] U.S. Cl. ..... 128/203.12; 128/200.14; 128/200.19; 128/204.18; 119/420

[58] Field of Search ..... 128/200.14, 200.19, 128/203.12, 203.29, 205.19, 205.25, 910, 204.18, 716, 203.22; 119/420

[56] References Cited

U.S. PATENT DOCUMENTS

| | | | |
|---|---|---|---|
| H145 | 10/1986 | James | 128/716 |
| 4,265,239 | 5/1981 | Fischer, Jr. et al. | 128/910 |
| 4,402,315 | 9/1983 | Tsuda et al. | 128/200.18 |
| 4,520,808 | 6/1985 | La Bauve | 128/200.14 |
| 4,721,060 | 1/1988 | Cannon et al. | 119/420 |
| 5,109,797 | 5/1992 | Briant et al. | 119/420 |
| 5,280,784 | 1/1994 | Köhler | 128/200.14 |
| 5,297,502 | 3/1994 | Jaeger | 119/15 |

FOREIGN PATENT DOCUMENTS

| | | |
|---|---|---|
| 1703087 | 1/1992 | U.S.S.R. . |

*Primary Examiner*—Jennifer Bahr
*Assistant Examiner*—V. Srivastava
*Attorney, Agent, or Firm*—Juliusz Szereszewski

[57] ABSTRACT

An apparatus for exposing laboratory animals to test substances comprises, generally, at least two supply manifolds for supplying each a gaseous or a vaporous substance, an exhaust manifold for removing an exhalate of said animals and unused portion of said test substance, and a plurality of inhalation chambers. Each chamber is dimensioned to accommodate a nasal part of the animal's head and is in fluid communication with the at least two supply manifolds and with the exhaust manifold. The apparatus is designed to prevent the streams of test substances hitting the animal's nostrils and causing an avoidance reaction.

12 Claims, 3 Drawing Sheets

RESPIRATORY NOSE-ONLY DEVICE AND SYSTEM FOR LABORATORY ANIMALS

FIELD OF THE INVENTION

This invention relates to respiratory devices for laboratory animals, particularly to such devices which enable a controlled delivery of a gaseous or vaporous substance to the nose and lungs of a laboratory animal without exposing the entire head or whole body of the animal to the substance.

BACKGROUND OF THE INVENTION

Several nose-only systems for the above-defined purpose are known. They are, among others, of the type known as "standard chamber" wherein aerosol flows through a common zone having holes through which the aerosol reaches an animal. Exhaled air and unused aerosol are returned to the same chamber and flow down the chamber to reach the next animal (see e.g. Cannon et al., Am. Ind. Hyg. Assoc. J. 44(12): 923–928 (1883) or U.S. Pat. No. 4,520,808)).

Another system, affording better uniformity of the flow of the substance administered to several animals at once is of a so-called flow-past design. Generally described in the above paper, this system is modified in several patents. For example, U.S. Pat. No. 5,297,502 describes an apparatus for exposing laboratory animals to a gas or vaporous substance directly to the nose of the animals and hence their respiratory system. The apparatus includes concentric inner and outer manifolds. The inner manifold is provided with a plurality of distribution tubes extending radially outward from the manifold, each tube having a horn shaped end. The outer manifold is provided with a plurality of apertured connectors through which the distribution tubes extend. The apertured connectors partially support animal holders such that the nose of an animal within each animal holder is positioned proximate to the horn end of one distribution tube. A gaseous substance is introduced from the lower end of the inner manifold, travels upwardly to the distribution tubes, through the tubes to the animal's noses, then passes through the apertured connectors where it enters the outer manifold. The vaporous substance is drawn upwardly out of the outer manifold.

The known flow-past nose-only units have one inlet pointed directly to the animal's nostrils to favour directional delivery of the substance tested to the respiratory system of the animal.

Other nose-only systems are described in, e.g., U.S. Pat. No. 1,703,087 and U.S. Pat. No. 5,280,784.

It is known that a laboratory animal may sometimes tend to avoid inhalation of the testing substance by trying to curl up (huddle) and withdraw its nose from the point of the delivery of the substance. It is desirable to prevent or minimize such an avoidance response for the sake of uniformity of the experiments.

It is an object of the present invention to optimize the nose-only delivery of the test substance to research animals, and in particular, to provide a system which would mimic a normal, or natural, exposure of the animal to the test substance.

It is another object of the invention to provide an apparatus enabling the exposure of laboratory animals to complex substances, e.g. binary substances, also those with a short lifetime.

It is further an object of the invention to provide a system with a relatively small dead space (space occupied by the unused substance) to enable relatively high concentrations of test substance with the use of relatively small amounts thereof.

It is another object of the invention to provide a nose-only inhalation system wherein the quantity and quality of the substance delivered to an animal under study can be individually controlled.

SUMMARY OF THE INVENTION

It has been found that the avoidance response of laboratory animals e.g. rats can be minimized or avoided when a stream of test substance is supplied to a spot which is spaced away from the nostrils of the animal, preferably at a low velocity.

According to the invention, there is provided an apparatus for exposing laboratory animals to test substances which comprises, generally, at least two separate supply manifolds for supplying each a gaseous or a vaporous substance, an exhaust manifold for removing an exhalate of said animals and unused portion of said test substance, a plurality of inhalation chambers, each chamber being dimensioned to accommodate a nasal part of the animal's head, wherein each inhalation chamber is in fluid communication separately with each of the at least two supply manifolds and in fluid communication separately with each of the exhaust manifold.

In a preferable embodiment of the invention, the apparatus further comprises means for directing, in operation, the flow of the substance from said at least two supply manifolds to the respective inhalation chambers such that the direction of the flow adjacent to the inlets is away from the nose of the animal when placed in the inhalation chamber, preferably at an angle to a direction of flow of the exhalate from said chamber adjacent to said outlet.

Further, the preferable embodiment of the invention assures that the velocity of flow of the test substance within the inhalation chambers is relatively low, and at least reduced significantly compared to the velocity of flow in the conduits linking the manifolds with the inhalation chambers.

BRIEF DESCRIPTION OF THE DRAWINGS

In drawings which illustrate the invention in more detail.

DETAILED DESCRIPTION OF THE INVENTION

Figure 1:
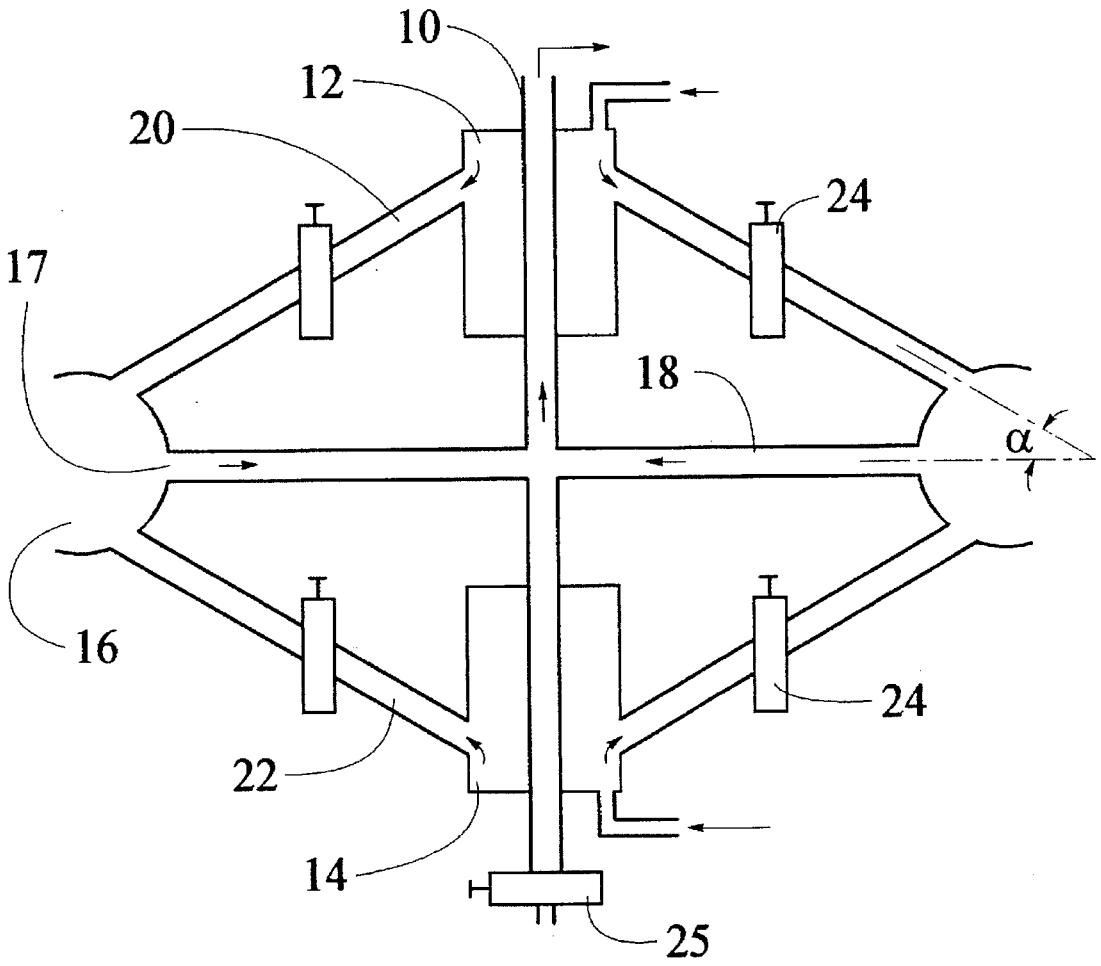
FIG. 1 is a schematic lateral view of an embodiment of the apparatus of the invention.

As seen in FIG. 1, the apparatus has a centrally disposed exhaust manifold 10 and two supply manifolds 12 and 14. The manifold 10 is connected with six peripheral hemispherical chambers 16 (only two being shown in FIG. 1) via conduits 18. The conduits 18 enter the chambers 16 at ports 17 which correspond to the location of the nasal/oral area of the head of the animal when placed under testing using said apparatus. The chambers 16 are also connected with the manifolds 12, 14 via conduits 20, 22. Valves 24 are installed on each of the conduits 20, 22 for flow control through the respective conduits. A sampling valve 25 is installed on the manifold 10 for periodical sampling.

The chambers 16, are of a size enabling only the animal's nose to be placed in the chamber. In the case of laboratory rats, the preferable maximum diameter of the chambers is about one inch, or 2.5 cm. As a result, the animal's body and head beyond the nasal/oral area are outside the chamber during the operation of the apparatus. It is important that the diameter of the conduits 20, 22 is much smaller (about 5 mm) than the diameter of the chambers 16. This creates a significant volume expansion and corresponding flow velocity reduction for a stream of test substance delivered to the chambers 16 through the respective conduits 20, 22.

For the purpose of testing animals using the apparatus of the invention, various means may be employed such as bottles used in the Jaeger apparatus of U.S. Pat. No. 5,297,502. The bottles, with animals therein, could be fastened to rims of the respective chambers 16 for instance by means of threaded connections, not illustrated herein.

It should be noted that, while two supply manifolds 12, 14 are illustrated herein, the number of the supply manifolds can be greater, e.g. three or four, depending on the need to supply a plurality of substances which are to be mixed only shortly before reaching the animal's respiratory system.

It will also be appreciated that it is desirable to avoid a direct flow of the test substances to the nostrils of the research animals. It is advantageous that the substances are first dispersed around the nasal area of the animal, at a low velocity, and then breathed in, thus better mimicking a normal exposure of the animal to the substances dispersed in the atmosphere.

In the embodiment illustrated, this objective is achieved by disposing the supply conduits 20, 22 such that they enter the chambers 16 at an angle $\alpha$, about 20°), relative to the respective exhaust conduit 18, and away from a port 17 at which the conduit 18 joins the chamber 16.

It is preferable but not essential that the conduits 18 are disposed radially relative to the manifolds 12, 14. Such an arrangement gives rise to the animal's exhaling directly into the exhaust conduit 18.

Figure 2:
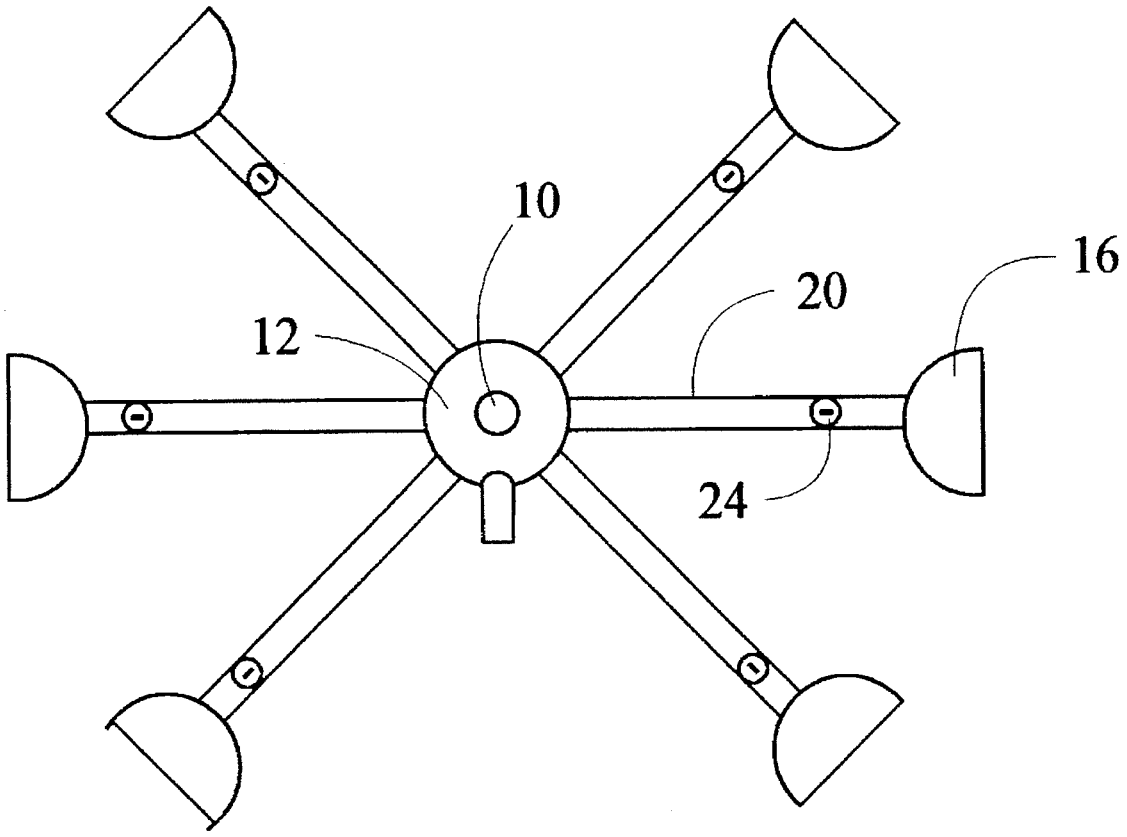
FIG. 2 is a plan view of the embodiment of FIG. 1.

As seen in FIG. 2, the chambers 16 are arranged peripherally and concentrically relative to the manifolds 10, 12 and 14. This is a space-saving measure, and one which enables a uniformity of delivery of test substances to all animals, if desired.

Figure 3:
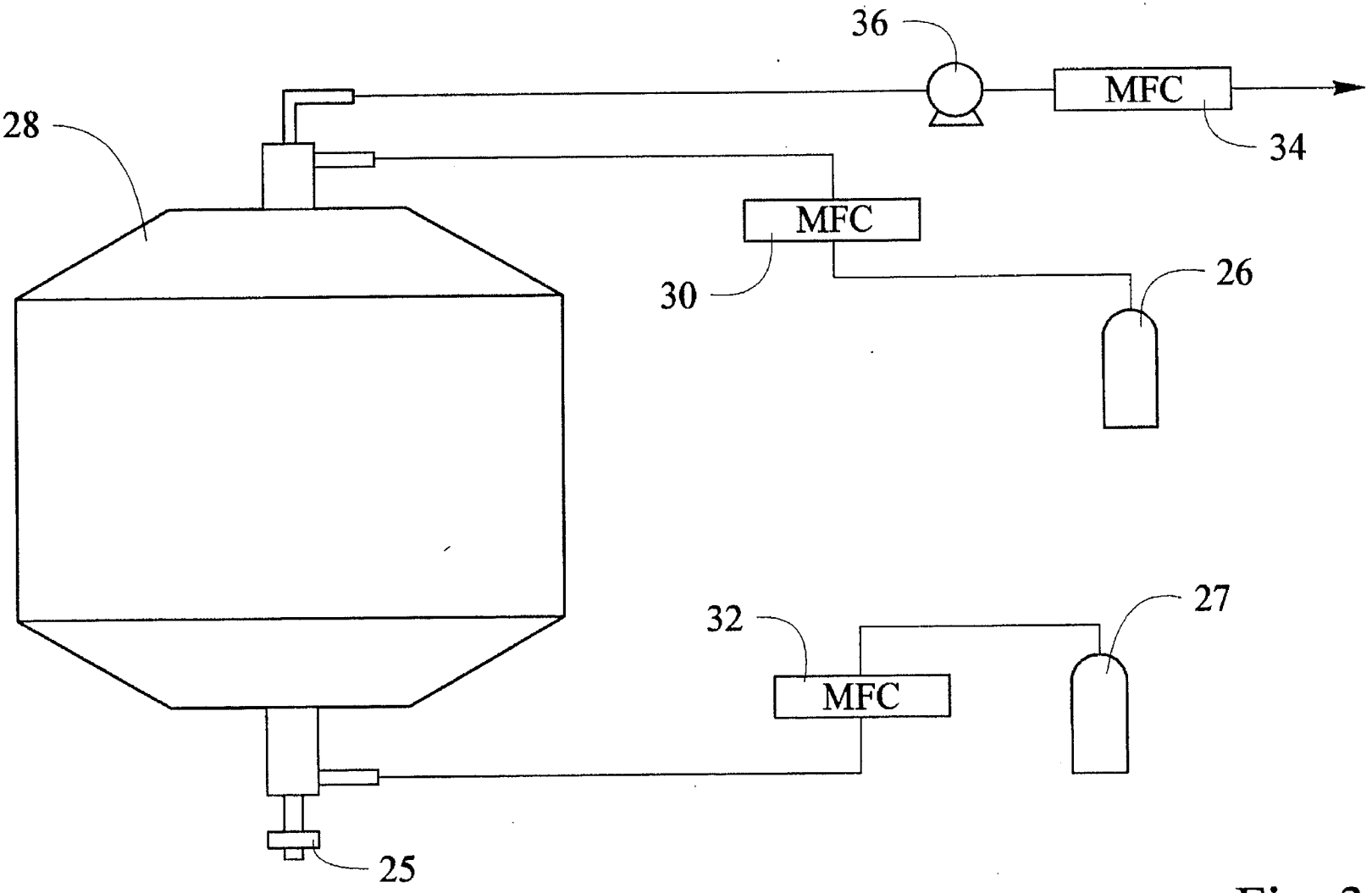
FIG. 3 is a schematic diagram of a system including the apparatus of the invention.

FIG. 3 illustrates a system including the apparatus of the invention. The system encompasses two sources of test substances, e.g. halothane container 26 and an oxygen container 27. The flow of these substances to the apparatus, indicated generally as 28, is controlled by means of mass flow controllers (MFC) 30, 32. The exhalate with unused part of the test substances is drawn from the apparatus via MFC 34 and a pump 36.

In operation, up to six animals are placed in bottles at the chambers 16 of the apparatus 28, and a flow of a test substance is admitted from the source 26, through a preset mass flow controller 30, into the manifold 12. Simultaneously, a flow of another substance is effected from the source 27 through a MFC 32, into the manifold 14. The flows of the substances are directed through lines 20, 22, the respective velocity being preset or continuously controlled via the respective valves 24 for each chamber 16 where the flows arrive at ports spaced away from the animal's nostrils as shown in FIG. 1. The flows mix and the animal inhales the mixture. The exhalate and the unused part of the mixture are drawn from the chambers via conduit 18, manifold 10, pump 36 and mass flow controller 34.

The latter flow is controlled such that a small negative pressure, in the order of 0.5 in. water is maintained in the chambers. This ensures that no dead space develops within the apparatus and that no deleterious chemical changes take place within the apparatus during the experiments, should the substances be prone to such changes.

It is evident that the device of the invention lends itself to a variety of testing procedures, wherein the ration of the binary streams, the flow to each of the respective chambers, the duration of the exposure and its type (continuous vs. periodical) and possibly other factors can be conveniently controlled.

Exemplary combinations of test substances are (binary mixtures):

air/ozone air/solid particles suspended in air air/carbon dioxide air/anaesthetic air/war chemicals air/free radicals (with short-life reaction products).

It is an advantage of the invention that the apparatus enables the delivery of various combinations of two or more different gaseous or vaporous substances, also relatively unstable mixtures or compounds, since the mixtures/compounds can be formed at the time of, or directly before, reaching the animal.

It is further an advantage of the invention that separate passageways are provided to respective inhalation chambers, wherein the diameter of the supply passageways and the size of the inhalation chambers is selected such that the velocity of flow of the test substance entering the chamber is rapidly reduced thus approximating natural exposure conditions as opposed to directional delivery of the stream of substance to the animal's nostrils. This in turn helps prevent or minimize the avoidance response of the animals tested.

The apparatus as illustrated lends itself to various modifications. For instance, the shape of the inhalation chambers may be adapted to more closely suit the shape of the animal's head or its nasal part. The apparatus may be manufactured either as a structure comprising tubular conduits, or as a block with passages drilled therethrough, for ease of sterilization. Further, the apparatus may be designed to accommodate larger number of animals at one time, e.g. eight, by simple routine design changes. All such modifications are meant to come within the ambit of the present invention as defined by the appended claims.

We claim:

1. An apparatus for exposing laboratory animals to a test substance, the apparatus comprising:

at least two separate supply manifolds for supplying each a gaseous or a vaporous substance, a plurality of inhalation chambers, each chamber dimensioned to accommodate a nasal part only of the animal's head, a first plurality of separate passageways each for conveying said substance from a first of said at least two supply manifolds directly to one of said inhalation chambers, a second plurality of separate passageways each for conveying said substance from a second of said two supply manifolds directly to one of said inhalation chambers, wherein said substances supplied through said at least two supply manifolds are substantially prevented from mixing with each other before entering said inhalation chambers respectively, and an exhaust manifold in fluid communication with said inhalation chambers for removing an exhalate of said animals and unused portion of said test substance.

2. The apparatus according to claim 1, comprising 2 a plurality of passageways for conveying exhalate separately from each of said chambers to said exhaust manifold.

3. The apparatus according to claim 1, further comprising flow-directing means for directing streams of said substances from said at least two supply manifolds into each of said inhalation chambers away from the nostrils of an animal when placed in said chamber.

4. The apparatus according to claim 1, comprising two supply manifolds, said inhalation chambers being disposed peripherally relative to said manifolds.

5. The apparatus according to claim 1, further comprising first control means disposed for controlling the flow of a said substance separately from one of said at least two supply manifolds to each of said inhalation chambers.

6. The apparatus according to claim 1, further comprising at least one source of said test substance in fluid communication with said supply manifold or manifolds.

7. The apparatus according to claim 6, further comprising second control means for controlling the flow of said test substance from said at least one source to said supply manifolds.

8. The apparatus according to claim 1 where said exhaust manifold is disposed concentrically relative to said supply manifolds.

9. The apparatus according to claim 6 wherein one of said sources is a source of air or oxygen.

10. The apparatus according to claim 1, wherein the cross-sectional size of said separate passageways is significantly smaller than a cross-sectional size of said inhalation chambers to cause, in operation, a significant reduction of flow velocity of said substances when entering said chambers.

11. An apparatus for exposing laboratory animals to a test substance or substances, the apparatus comprising:

an exhaust manifold, at least two separate supply manifolds disposed concentrically relative to said exhaust manifolds, a plurality of inhalation chambers disposed peripherally relative to said exhaust manifold and said supply manifolds, a plurality of exhaust conduits, each conduit extending substantially radially from said exhaust manifold to one of said inhalation chambers, for conveying exhalate from said inhalation chambers to said exhaust manifold, a first plurality of separate conduits each for conveying said substance from a first of said at least two supply manifolds directly to one of said inhalation chambers, a second plurality of separate conduits each for conveying said substance from a second of said two supply manifolds directly to one of said inhalation chambers, wherein said substances supplied through said at least two supply manifolds are substantially prevented from mixing with each other before entering said inhalation chambers respectively, each of said chambers having a cross-sectional size significantly exceeding a cross-sectional size of each of said supply conduits, and means for directing, in operation, a flow of said substances supplied into said inhalation chambers, away from the nostrils of said animal when placed in said apparatus.

12. The apparatus according to claim 11 wherein each of said chambers has at least two inlet ports corresponding to said supply conduits, said inlet ports and supply conduits being disposed such as to cause, in operation, a stream of said substance to be directed to a spot within said chamber spaced away from the nostrils of said animal.

* * * * *